US011310619B2

(12) United States Patent
Honma et al.

(10) Patent No.: US 11,310,619 B2
(45) Date of Patent: Apr. 19, 2022

(54) SIGNAL PROCESSING DEVICE AND METHOD, AND PROGRAM

(71) Applicant: Sony Corporation, Tokyo (JP)

(72) Inventors: Hiroyuki Honma, Chiba (JP); Toru Chinen, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 16/770,565

(22) PCT Filed: Nov. 28, 2018

(86) PCT No.: PCT/JP2018/043695
§ 371 (c)(1),
(2) Date: Jun. 5, 2020

(87) PCT Pub. No.: WO2019/116890
PCT Pub. Date: Jun. 20, 2019

(65) Prior Publication Data

US 2021/0168548 A1 Jun. 3, 2021

(30) Foreign Application Priority Data

Dec. 12, 2017 (JP) ..... JP2017-237402

(51) Int. Cl.
*H04S 7/00* (2006.01)
*H04S 3/00* (2006.01)
*G10L 19/008* (2013.01)

(52) U.S. Cl.
CPC ..... *H04S 7/303* (2013.01); *H04S 3/002* (2013.01); *H04S 3/008* (2013.01); *G10L 19/008* (2013.01);
(Continued)

(58) Field of Classification Search
CPC .. H04S 7/303; H04S 2420/01; H04S 2400/01; H04S 2400/11
See application file for complete search history.

(56) References Cited

U.S. PATENT DOCUMENTS

2012/0070021 A1 3/2012 Yoo et al.
2014/0133683 A1 5/2014 Robinson et al.
(Continued)

FOREIGN PATENT DOCUMENTS

CN 1498035 A 5/2004
CN 105144751 A 12/2015
(Continued)

OTHER PUBLICATIONS

International Search Report and English translation thereof dated Feb. 19, 2019 in connection with International Application No. PCT/JP2018/043695.
(Continued)

*Primary Examiner* — Ping Lee
(74) *Attorney, Agent, or Firm* — Wolf, Greenfield & Sacks, P.C.

(57) ABSTRACT

The present technology relates to a signal processing device and method, and a program for improving reproducibility of a sound image with a small amount of calculation.
A signal processing device includes a rendering method selection unit configured to select one or more methods of rendering processing of localizing a sound image of an audio signal in a listening space from among a plurality of methods, and a rendering processing unit configured to perform the rendering processing for the audio signal by the method selected by the rendering method selection unit. The present technology can be applied to a signal processing device.

6 Claims, 12 Drawing Sheets

(52) U.S. Cl.
CPC ..... *H04S 2400/01* (2013.01); *H04S 2400/11* (2013.01); *H04S 2420/01* (2013.01)

(56) References Cited

U.S. PATENT DOCUMENTS

| | | | | |
|---|---|---|---|---|
| 2016/0007133 | A1* | 1/2016 | Mateos Sole | H04S 5/005 381/18 |
| 2016/0066118 | A1 | 3/2016 | Oh et al. | |
| 2016/0080886 | A1 | 3/2016 | De Bruijn | |
| 2017/0325045 | A1 | 11/2017 | Baek | |
| 2017/0366912 | A1* | 12/2017 | Stein | H04S 7/304 |
| 2019/0104366 | A1* | 4/2019 | Johnson | H04R 5/04 |
| 2021/0029485 | A1 | 1/2021 | Namba et al. | |
| 2021/0195356 | A1* | 6/2021 | Oh | G10L 19/20 |

FOREIGN PATENT DOCUMENTS

| | | | |
|---|---|---|---|
| CN | 105191354 | A | 12/2015 |
| CN | 105379309 | A | 3/2016 |
| CN | 105684466 | A | 6/2016 |
| EP | 2806658 | A1 | 11/2014 |
| JP | 2011-124974 | A | 6/2011 |
| JP | 5752414 | B2 | 7/2015 |
| JP | 2016-039568 | A | 3/2016 |
| JP | 2017-215592 | A | 12/2017 |
| WO | WO 2018/047667 | A1 | 3/2018 |

OTHER PUBLICATIONS

[No Author Listed], ETSI TS 103 448 v1.1.1 Technical Specification. AC-4 Object Audio Renderer for Consumer Use. EBU Operating Eurovision. 2016. 39 pages.

[No Author Listed], International Standard ISO/IEC 23008-3. Information technology—High efficiency coding and media delivery in heterogeneous environments—Part 3: 3D audio. Feb. 1, 2016. 439 pages.

* cited by examiner

FIG. 4

| Syntax | No. of bits | Mnemonic |
|---|---|---|
| object_metadata() | | |
| { | | |
| for ( i=0; i < num_objects; i++) { | | |
| position_azimuth[i]; | 8 | tcimsbf |
| position_elevation[i]; | 6 | tcimsbf |
| position_radius[i]; | 7 | uimsbf |
| } | | |
| } | | |

FIG. 10

| Syntax | No. of bits | Mnemonic |
|---|---|---|
| object_metadata() | | |
| { | | |
| for ( i=0; i < num_objects; i++) { | | |
| position_azimuth[i]; | 8 | tcimsbf |
| position_elevation[i]; | 6 | tcimsbf |
| position_radius[i]; | 7 | uimsbf |
| } | | |
| radius_hrtf | 7 | uimsbf |
| radius_panning | 7 | uimsbf |
| } | | |

FIG. 11

| Syntax | No. of bits | Mnemonic |
|---|---|---|
| object_metadata() | | |
| { | | |
| for ( i=0; i < num_objects; i++) { | | |
| position_azimuth[i]; | 8 | tcimsbf |
| position_elevation[i]; | 6 | tcimsbf |
| position_radius[i]; | 7 | uimsbf |
| flg_rendering_type | 1 | uimsbf |
| } | | |
| } | | |

SIGNAL PROCESSING DEVICE AND METHOD, AND PROGRAM

CROSS-REFERENCE TO RELATED APPLICATIONS

This application claims the benefit under 35 U.S.C. § 371 as a U.S. National Stage Entry of International Application No. PCT/JP2018/043695, filed in the Japanese Patent Office as a Receiving Office on Nov. 28, 2018, which claims priority to Japanese Patent Application Number JP2017-237402, filed in the Japanese Patent Office on Dec. 12, 2017, each of which is hereby incorporated by reference in its entirety.

TECHNICAL FIELD

The present technology relates to a signal processing device and method, and a program, and more particularly to a signal processing device and method, and a program for improving reproducibility of a sound image with a small amount of calculation

BACKGROUND ART

Conventionally, object audio technologies have been used in movies, games, and the like, and coding methods that can handle object audio have been developed. Specifically, for example, moving picture experts group (MPEG)-H Part 3:3D audio standard, which is an international standard, and the like are known (for example, see Non-Patent Document 1).

In such a coding method, a moving sound source or the like is treated as an independent audio object, and position information of the object can be coded together with signal data of the audio object as metadata, like a conventional two-channel stereo method or a multi-channel stereo method such as 5.1 channel.

By doing so, reproduction can be performed in various listening environments where the number of speakers or layouts of speakers are different. Furthermore, a sound of a specific sound source can be easily processed at the time of reproduction, such as adjustment of a volume of the sound of a specific sound source or addition of an effect to the sound of a specific sound source, which have been difficult by the conventional coding method.

For example, in the standard of Non-Patent Document 1, a method called three-dimensional vector based amplitude panning (VBAP) (hereinafter, simply referred to as VBAP) is used for rendering processing.

This method is one of rendering methods generally called panning, and is a method of performing rendering by distributing a gain to three speakers closest to an audio object existing on a sphere surface having an origin at a listening position, among speakers existing on the sphere surface.

Furthermore, rendering processing by a panning method called speaker-anchored coordinates panner of distributing a gain to an x axis, a y axis, and a z axis is also known in addition to VBAP (for example, see Non-Patent Document 2).

Meanwhile, as a method of rendering an audio object, a method using a head-related transfer function filter has been also proposed, in addition to the panning processing (for example, see Patent Document 1).

In a case of rendering a moving audio object using a head-related transfer function, a head-related transfer function filter is generally often obtained, as follows.

That is, for example, it is common to sample a moving space range and prepare a large number of head-related transfer function filters corresponding to individual points in the space in advance. Furthermore, for example, a head-related transfer function filter of a desired position is sometimes obtained by distance correction by a three-dimensional synthesis method, using head-related transfer functions at positions in a space, the positions being measured at fixed distance intervals.

Patent Document 1 describes a method of generating a head-related transfer function filter of an arbitrary distance, using parameters necessary for generating a filter for a head-related transfer function, the parameters being obtained by sampling a sphere surface at a certain distance.

CITATION LIST

Non-Patent Document

Non-Patent Document 1: INTERNATIONAL STANDARD ISO/IEC 23008-3 First edition 2015-10-15 Information technology High efficiency coding and media delivery in heterogeneous environments Part 3:3D audio Non-Patent Document 2: ETSI TS 103 448 v1.1.1 (2016-09)

Patent Document

Patent Document 1: Japanese Patent No. 5752414

SUMMARY OF THE INVENTION

Problems to be Solved by the Invention

However, with the above-described technology, it has been difficult to obtain reproducibility with high sound image localization and a small amount of calculation in a case of localizing a sound image of an audio object by rendering. That is, it has been difficult to implement localization of a sound image that is perceived as if being located at an originally intended position with a small amount of calculation.

For example, rendering for an audio object by the panning processing is performed on the assumption that the listening position is one point. In this case, for example, when the audio object is near the listening position, a difference in arrival time between a sound wave reaching the left ear of a listener and a sound wave reaching the right ear of the listener cannot be ignored.

However, in a case of performing VBAP as the panning processing, rendering is performed on the assumption that the audio object is on the sphere surface even if the audio object is located inside or outside the sphere surface on which speakers are arranged. Then, in a case where the audio object approaches the listening position, the sound image of the audio object at the time of reproduction is far from what is expected.

Meanwhile, in rendering using a head-related transfer function, reproducibility of high sound image localization can be implemented even in the case where the audio object is near the listener. Furthermore, there are pieces of high-speed calculation processing such as fast Fourier transform (FFT) and quadrature mirror filter (QMF) as finite impulse response (FIR) filter processing using a head-related transfer function.

However, the amount of the FIR filter processing using a head-related transfer function is much larger than the amount of panning processing. Therefore, when there are many audio objects, it may not be appropriate to render all the audio objects using head-related transfer functions.

The present technology has been made in view of such a situation, and is intended to improve the reproducibility of a sound image with a small amount of calculation.

Solutions to Problems

A signal processing device according to one aspect of the present technology includes a rendering method selection unit configured to select one or more methods of rendering processing of localizing a sound image of an audio signal in a listening space from among a plurality of methods, and a rendering processing unit configured to perform the rendering processing for the audio signal by the method selected by the rendering method selection unit.

A signal processing method or a program according to one aspect of the present technology includes the steps of selecting one or more methods of rendering processing of localizing a sound image of an audio signal in a listening space from among a plurality of methods different from one another, and performing the rendering processing for the audio signal by the selected method.

In one aspect of the present technology, one or more methods of rendering processing of localizing a sound image of an audio signal in a listening space are selected from among a plurality of methods different from one another, and the rendering processing for the audio signal is performed by the selected method.

Effects of the Invention

According to one aspect of the present technology, reproducibility of a sound image can be improved with a small amount of calculation.

Note that the effects described here are not necessarily limited, and any of effects described in the present disclosure may be exhibited.

BRIEF DESCRIPTION OF DRAWINGS

FIG. 4 is a diagram illustrating an example of metadata.

FIG. 10 is a diagram illustrating an example of metadata.

FIG. 11 is a diagram illustrating an example of metadata.

MODE FOR CARRYING OUT THE INVENTION

Hereinafter, embodiments to which the present technology is applied will be described with reference to the drawings.

First Embodiment

<Present Technology>

The present technology improves reproducibility of a sound image even with a small amount of calculation by selecting, for each audio object, one or more methods from among a plurality of rendering methods different from one another according to a position of the audio object in a listening space, in a case of rendering the audio object. That is, the present technology implements localization of a sound image that is perceived as if being at an originally intended position even with a small amount of calculation.

In particular, in the present technology, one or more rendering methods are selected from among a plurality of rendering methods having different amounts of calculation (calculation loads) and different sound image localization performances from one another, as a method of rendering processing of localizing a sound image of an audio signal in a listening space, that is, a rendering method.

Note that, here, a case where the audio signal for which a rendering method is to be selected is an audio signal of an audio object (audio object signal) will be described as an example. However, an example is not limited to the case, and the audio signal for which a rendering method is to be selected may be any audio signal as long as the audio signal is for localizing a sound image in a listening space.

As described above, in VBAP, a gain is distributed to three speakers closest to an audio object existing on a sphere surface having an origin at a listening position in a listening space, among speakers existing on the sphere surface.

Figure 1:
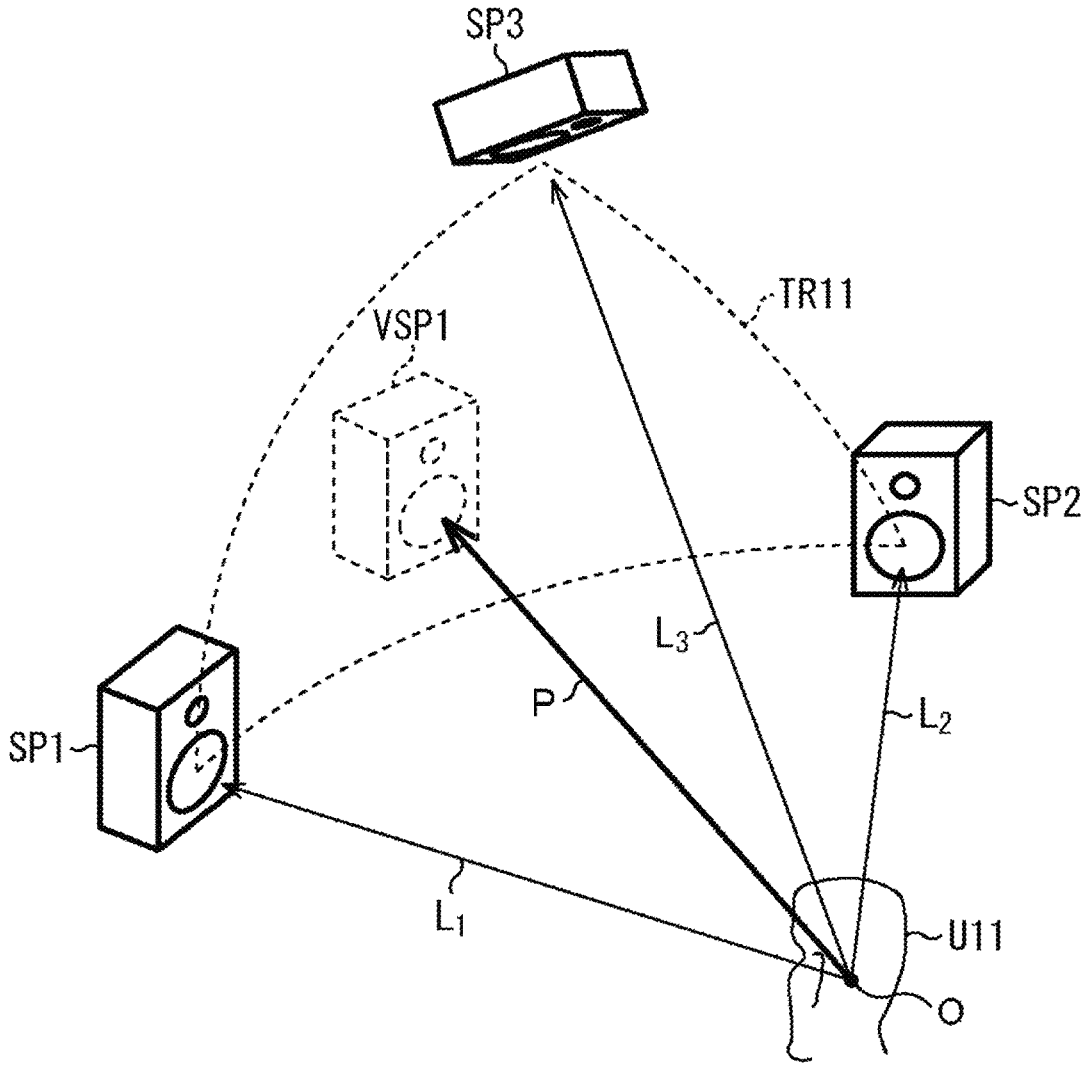
FIG. 1 is a diagram for describing VBAP.

For example, as illustrated in FIG. 1, it is assumed that a listener U11 is present in a listening space that is a three-dimensional space, and three speakers SP1 to SP3 are arranged in front of the listener U11.

Furthermore, it is assumed that the position of the head of the listener U11 is set as an origin O, and the speakers SP1 to SP3 are located on a spherical surface centered on the origin O.

Now, it is assumed that an audio object exists in a region TR11 surrounded by the speakers SP1 to SP3 on the sphere surface, and a sound image is localized at a position VSP1 of the audio object.

In such a case, in VBAP, a gain of the audio object is distributed to the speakers SP1 to SP3 around the position VSP1.

Specifically, it is assumed that the position VSP1 is expressed by a three-dimensional vector P having the origin O as a starting point and the position VSP1 as an end point in a three-dimensional coordinate system with respect to the origin O (origin).

Furthermore, the vector P can be expressed by a linear sum of vectors $L_1$ to $L_3$, as described in the following expression (1), where the three-dimensional vectors having the origin O as the starting point and the positions of the speakers SP1 to SP3 as end points are the vectors $L_1$ to $L_3$.

[Math. 1]

$$P=g_1L_1+g_2L_2+g_3L_3 \tag{1}$$

Here, in the expression (1), coefficients $g_1$ to $g_3$ multiplied with the vectors $L_1$ to $L_3$ are calculated, and these coefficients $g_1$ to $g_3$ are set as gains of sounds respectively output from the speakers SP1 to SP3, so that the sound image can be localized at the position VSP1.

For example, the following expression (2) can be obtained by modifying the above-described expression (1), where a vector having the coefficients $g_1$ to $g_3$ as elements is $g_{123}=$ $[g_1, g_2, g_3]$, and the vector having the vectors $L_1$ to $L_3$ as elements is $L_{123}=[L_1, L_2, L_3]$.

[Math. 2]

$$g_{123}=P^T L_{123}^{-1} \quad (2)$$

By outputting an audio object signal that is a signal of a sound of the audio object to the speakers SP1 to SP3, using the coefficients $g_1$ to $g_3$ obtained by calculating such an expression (2) as gains, the sound image can be localized at the position VSP1.

Note that, since the arrangement positions of the speakers SP1 to SP3 are fixed and information indicating the positions of the speakers is known, an inverse matrix $L_{123}^{-1}$ can be obtained in advance. Therefore, in VBAP, rendering can be performed with relatively easy calculation, that is, with a small amount of calculation.

Therefore, in a case where the audio object is located at a position sufficiently distant from the listener U11, the sound image can be appropriately localized with a small amount of calculation by performing rendering by the panning processing such as VBAP.

However, when the audio object is located at a position close to the listener U11, expressing the difference in arrival time between sound waves reaching the right and left ears of the listener U11 has been difficult by the panning processing such as VBAP, and sufficiently high sound image reproducibility has not been able to be obtained.

Therefore, in the present technology, one or more rendering methods are selected from the panning processing and the rendering processing using a head-related transfer function filter (hereinafter, also referred to as head-related transfer function processing) according to the position of the audio object, and rendering processing is performed.

For example, the rendering method is selected on the basis of a relative positional relationship between the listening position that is the position of the listener in the listening space and the position of the audio object.

Specifically, as an example, in a case where the audio object is located on or outside the sphere surface on which the speakers are arranged, for example, the panning processing such as VBAP is selected as the rendering method.

In contrast, in a case where the audio object is located inside the sphere surface on which the speakers are arranged, the head-related transfer function processing is selected as the rendering method.

With such selection, sufficiently high sound image reproducibility can be obtained with a small amount of calculation. That is, the reproducibility of the sound image can be improved with a small amount of calculation.

<Configuration Example of Signal Processing Device>

Hereinafter, the present technology will be described in detail.

Figure 2:
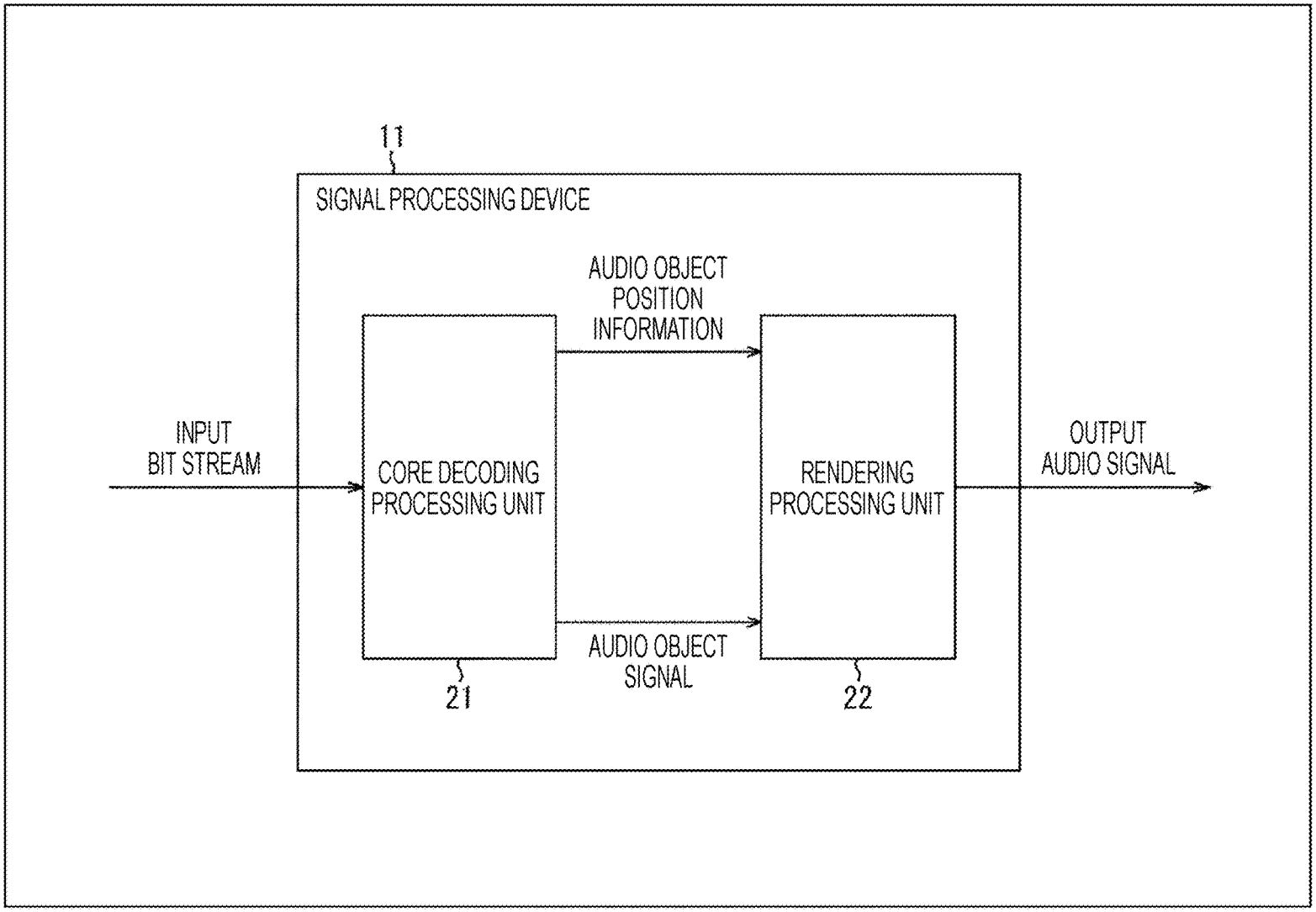
FIG. 2 is a diagram illustrating a configuration example of a signal processing device.

FIG. 2 is a diagram illustrating a configuration example of an embodiment of a signal processing device to which the present technology is applied.

A signal processing device 11 illustrated in FIG. 2 includes a core decoding processing unit 21 and a rendering processing unit 22.

The core decoding processing unit 21 receives and decodes a transmitted input bit stream, and supplies audio object position information and an audio object signal obtained as a result of the decoding to the rendering processing unit 22. In other words, the core decoding processing unit 21 acquires the audio object position information and the audio object signal.

Here, the audio object signal is an audio signal for reproducing a sound of an audio object.

Furthermore, the audio object position information is meta data of an audio object, that is, an audio object signal, which is necessary for rendering performed by the rendering processing unit 22.

Specifically, the audio object position information is information indicating a position in a three-dimensional space, that is, in a listening space, of the audio object.

The rendering processing unit 22 generates an output audio signal on the basis of the audio object position information and the audio object signal supplied from the core decoding processing unit 21, and supplies the output audio signal to a speaker, a recording unit, and the like at subsequent stage.

Specifically, the rendering processing unit 22 selects any one of the panning processing, the head-related transfer function processing, or the panning processing and the head-related transfer function processing, as a rendering method, that is, rendering processing, on the basis of the audio object position information.

Then, the rendering processing unit 22 performs the selected rendering processing to perform rendering for a reproduction device such as a speaker or a headphone serving as an output destination of the output audio signal, to generate the output audio signal.

Note that the rendering processing unit 22 may select one or more rendering methods from among three or more rendering methods different from one another including the panning processing and the head-related transfer function processing.

<Configuration Example of Rendering Processing Unit>

Next, a more detailed configuration example of the rendering processing unit 22 of the signal processing device 11 illustrated in FIG. 2 will be described.

Figure 3:
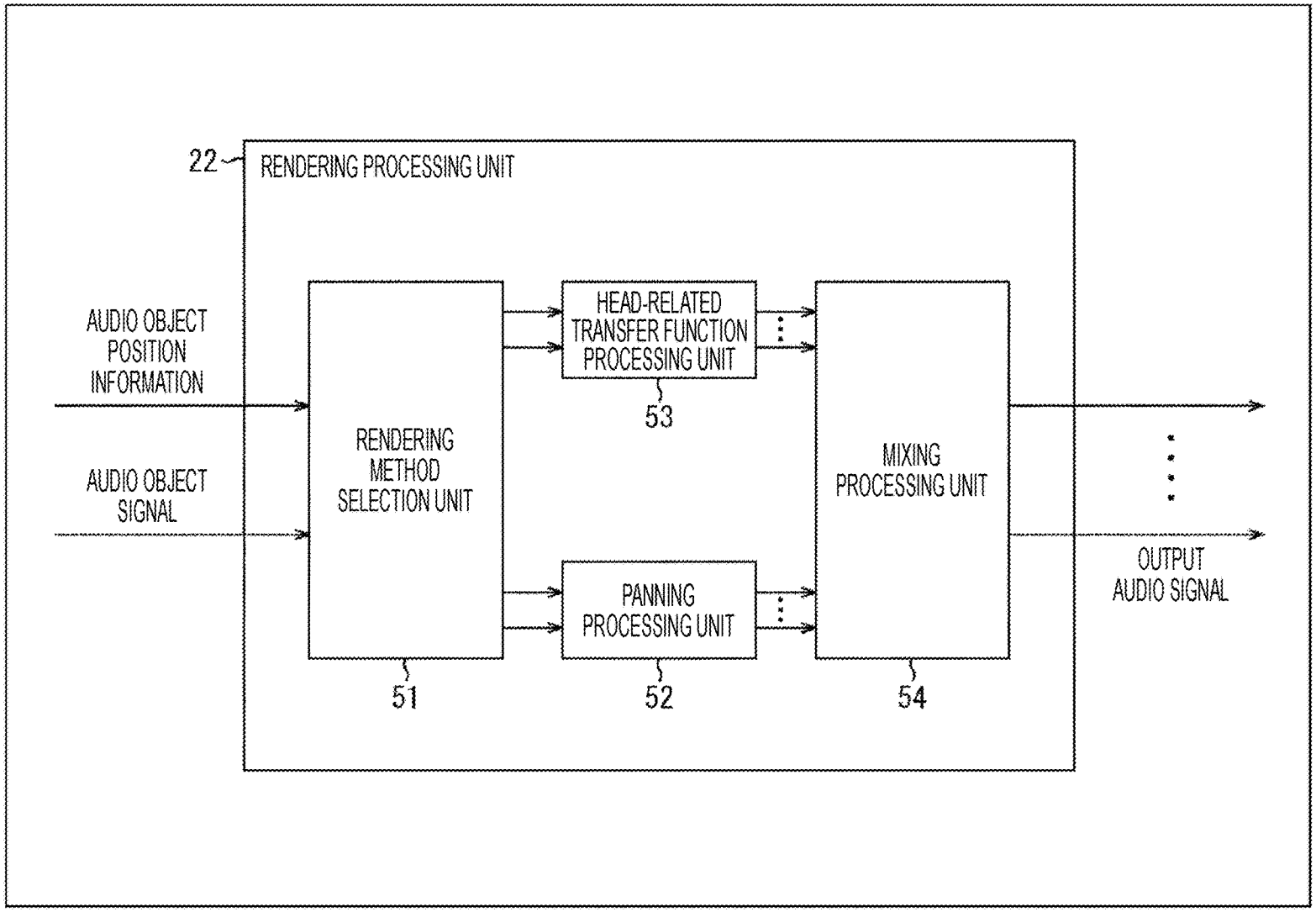
FIG. 3 is a diagram illustrating a configuration example of a rendering processing unit.

The rendering processing unit 22 is configured as illustrated in FIG. 3, for example.

In the example illustrated in FIG. 3, the rendering processing unit 22 includes a rendering method selection unit 51, a panning processing unit 52, a head-related transfer function processing unit 53, and a mixing processing unit 54.

To the rendering method selection unit 51, the audio object position information and the audio object signal are supplied from the core decoding processing unit 21.

The rendering method selection unit 51 selects, for each audio object, a rendering processing method, that is, a rendering method, for the audio object, on the basis of the audio object position information supplied from the core decoding processing unit 21.

Furthermore, the rendering method selection unit 51 supplies the audio object position information and the audio object signal supplied from the core decoding processing unit 21 to at least either the panning processing unit 52 or the head-related transfer function processing unit 53 according to the selection result of the rendering method The panning processing unit 52 performs the panning processing on the basis of the audio object position information and the audio object signal supplied from the rendering method selection unit 51, and supplies a panning processing output signal obtained as a result of the panning processing to the mixing processing unit 54.

Here, the panning processing output signal is an audio signal of each channel for reproducing a sound of an audio object such that a sound image of the sound of the audio object is localized at a position in the listening space indicated by the audio object position information.

For example, here, a channel configuration of the output destination of the output audio signal is determined in advance, and the audio signal of each channel of the channel configuration is generated as the panning processing output signal.

As an example, for example, in a case where the output destination of the output audio signal is a speaker system including the speakers SP1 to SP3 illustrated in FIG. 1, audio signals of channels respectively corresponding to the speakers SP1 to SP3 are generated as the panning processing output signals.

Specifically, for example, in a case where VBAP is performed as the panning processing, the audio signal obtained by multiplying the audio object signal supplied from the rendering method selection unit 51 by the coefficient $g_1$ as a gain is used as the panning processing output signal of the channel corresponding to the speaker SP1. Similarly, the audio signals obtained by respectively multiplying the audio object signal by the coefficients $g_2$ and $g_3$ are used as the panning processing output signals of the channels respectively corresponding to the speakers SP2 and SP3.

Note that, in the panning processing unit 52, any processing may be performed as the panning processing, such as VBAP adopted in the MPEG-H Part 3:3D audio standard, or processing by a panning method called speaker-anchored coordinates panner, for example. In other words, the rendering method selection unit 51 may select VBAP or the speaker-anchored coordinates panner as the rendering method.

The head-related transfer function processing unit 53 performs the head-related transfer function processing on the basis of the audio object position information and the audio object signal supplied from the rendering method selection unit 51, and supplies a head-related transfer function processing output signal obtained as a result of the head-related transfer function processing to the mixing processing unit 54.

Here, the head-related transfer function processing output signal is an audio signal of each channel for reproducing a sound of an audio object such that a sound image of the sound of the audio object is localized at a position in the listening space indicated by the audio object position information.

That is, the head-related transfer function processing output signal corresponds to the panning processing output signal. The head-related transfer function processing output signal and the panning processing output signal are different in processing when the audio signal is generated, which is either the head-related transfer function processing or the panning processing.

The above panning processing unit 52 or head-related transfer function processing unit 53 functions as the rendering processing unit that performs the rendering processing such as the panning processing or the head-related transfer function processing by the rendering method selected by the rendering method selection unit 51.

The mixing processing unit 54 generates the output audio signal on the basis of at least either one of the panning processing output signal supplied from the panning processing unit 52 or the head-related transfer function processing output signal supplied from the head-related transfer function processing unit 53, and outputs the output audio signal to a subsequent stage.

For example, it is assumed that the audio object position information and the audio object signal of one audio object are stored in the input bit stream.

In such a case, when the panning processing output signal and the head-related transfer function processing output signal are supplied, the mixing processing unit 54 performs correction processing and generates the output audio signal. In the correction processing, the panning processing output signal and the head-related transfer function processing output signal are combined (blended) for each channel to obtain the output audio signal.

In contrast, in a case where only one of the panning processing output signal and the head-related transfer function processing output signal is supplied, the mixing processing unit 54 uses the supplied signal as it is as the output audio signal.

Furthermore, for example, it is assumed that the audio object position information and the audio object signals of a plurality of audio objects are stored in the input bit stream.

In such a case, the mixing processing unit 54 performs correction processing as necessary and generates the output audio signal for each audio object.

Then, the mixing processing unit 54 performs mixing processing of adding (combining) the output audio signals of the audio objects thus obtained to obtain an output audio signal of each channel obtained as a result of the mixing processing as a final output audio signal. That is, the output audio signals of the same channel obtained for the audio objects are added to obtain the final output audio signal of the channel.

As described above, the mixing processing unit 54 functions as an output audio signal generation unit that performs, for example, the correction processing and the mixing processing for combining the panning processing output signal and the head-related transfer function processing output signal as necessary and generates the output audio signal.

<Audio Object Position Information>

By the way, the above-described audio object position information is encoded using, for example, a format illustrated in FIG. 4 at predetermined time intervals (every predetermined number of frames), and is stored in the input bit stream.

In the metadata illustrated in FIG. 4, "num_objects" indicates the number of audio objects included in the input bit stream.

Furthermore, "tcimsbf" is an abbreviation for "Two's complement integer, most significant (sign) bit first", and the sign bit indicates a leading two's complement number. "uimsbf" is an abbreviation for "Unsigned integer, most significant bit first", and the most significant bit indicates a leading unsigned integer.

Moreover, each of "position_azimuth [i]", "position_elevation [i]", and "position_radius [i]" indicates the audio object position information of the i-th audio object included in the input bit stream.

Specifically, "position_azimuth [i]" indicates an azimuth of the position of the audio object in a spherical coordinate system, and "position_elevation [i]" indicates an elevation of the position of the audio object in the spherical coordinate system. Furthermore, "position_radius [i]" indicates a distance to the position of the audio object in the spherical coordinate system, that is, a radius.

Figure 5:
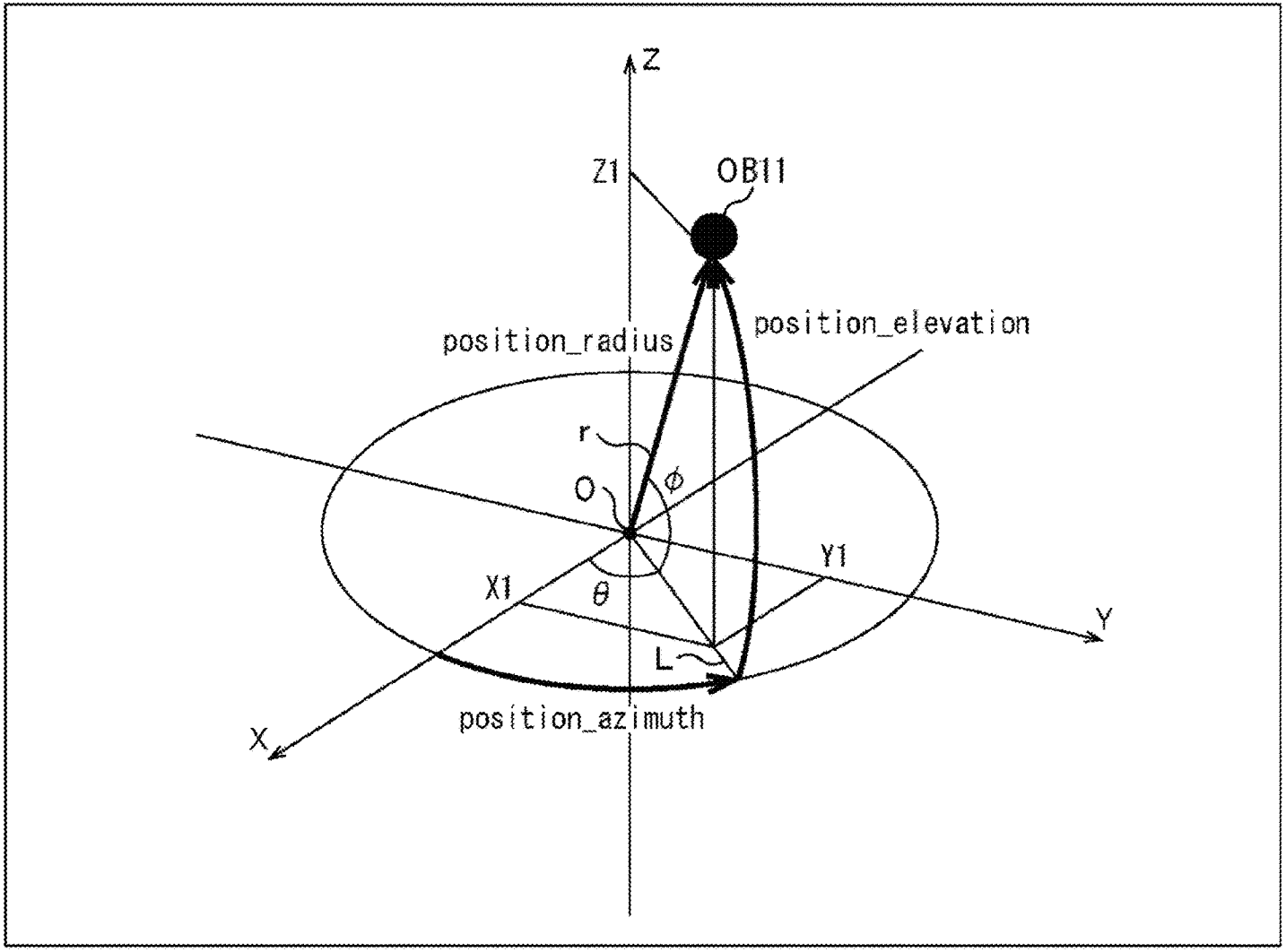
FIG. 5 is a diagram for describing audio object position information.

Here, the relationship between the spherical coordinate system and a three-dimensional orthogonal coordinate system is as illustrated in FIG. 5.

In FIG. 5, an X-axis, a Y-axis, and a Z-axis, which pass through the origin O and are perpendicular to each other, are axes in the three-dimensional orthogonal coordinate system. For example, in the three-dimensional orthogonal coordinate system, the position of an audio object OB11 in the space is expressed as (X1, Y1, Z1), using X1 that is an X coordinate indicating the position in an X-axis direction, Y1 that is a Y coordinate indicating the position in a Y-axis direction, and Z1 that is a Z coordinate indicating the position in a Z-axis direction.

In contrast, in the spherical coordinate system, the position of the audio object OB11 in the space is expressed using an azimuth position_azimuth, an elevation position_elevation, and a radius position_radius.

Now, it is assumed that a straight line connecting the origin O and the position of the audio object OB11 in the listening space be a straight line r, and a straight line obtained by projecting the straight line r on an XY plane be a straight line L.

At this time, an angle θ made by the X axis and the straight line L is defined as the azimuth position_azimuth indicating the position of the audio object OB11, and this angle θ corresponds to the azimuth position_azimuth [i] illustrated in FIG. 4.

Furthermore, an angle φ made by the straight line r and the XY plane is the elevation position_elevation indicating the position of the audio object OB11, and the length of the straight line r is the radius position_radius indicating the position of the audio object OB11.

That is, the angle φ corresponds to the elevation position_elevation [i] illustrated in FIG. 4, and the length of the straight line r corresponds to the radius position_radius [i] illustrated in FIG. 4.

For example, the position of the origin O is the position of a listener (user) who listens to a sound of content including a sound of an audio object and the like, and a positive direction in the X direction (X-axis direction), that is, a front direction in FIG. 5, is a front direction as viewed from the listener, and a positive direction in the Y direction (Y-axis direction), that is, a right direction in FIG. 5, is a left direction as viewed from the listener.

As described above, in the audio object position information, the position of the audio object is expressed by spherical coordinates.

The position in the listening space of the audio object indicated by such audio object position information is a physical quantity that changes in every predetermined time section. At the time of reproducing the content, a sound image localization position of the audio object can be moved according to the change of the audio object position information.

<Selection of Rendering Method>

Next, a specific example of the selection of the rendering method by the rendering method selection unit 51 will be described with reference to FIGS. 6 to 8.

Figure 6:
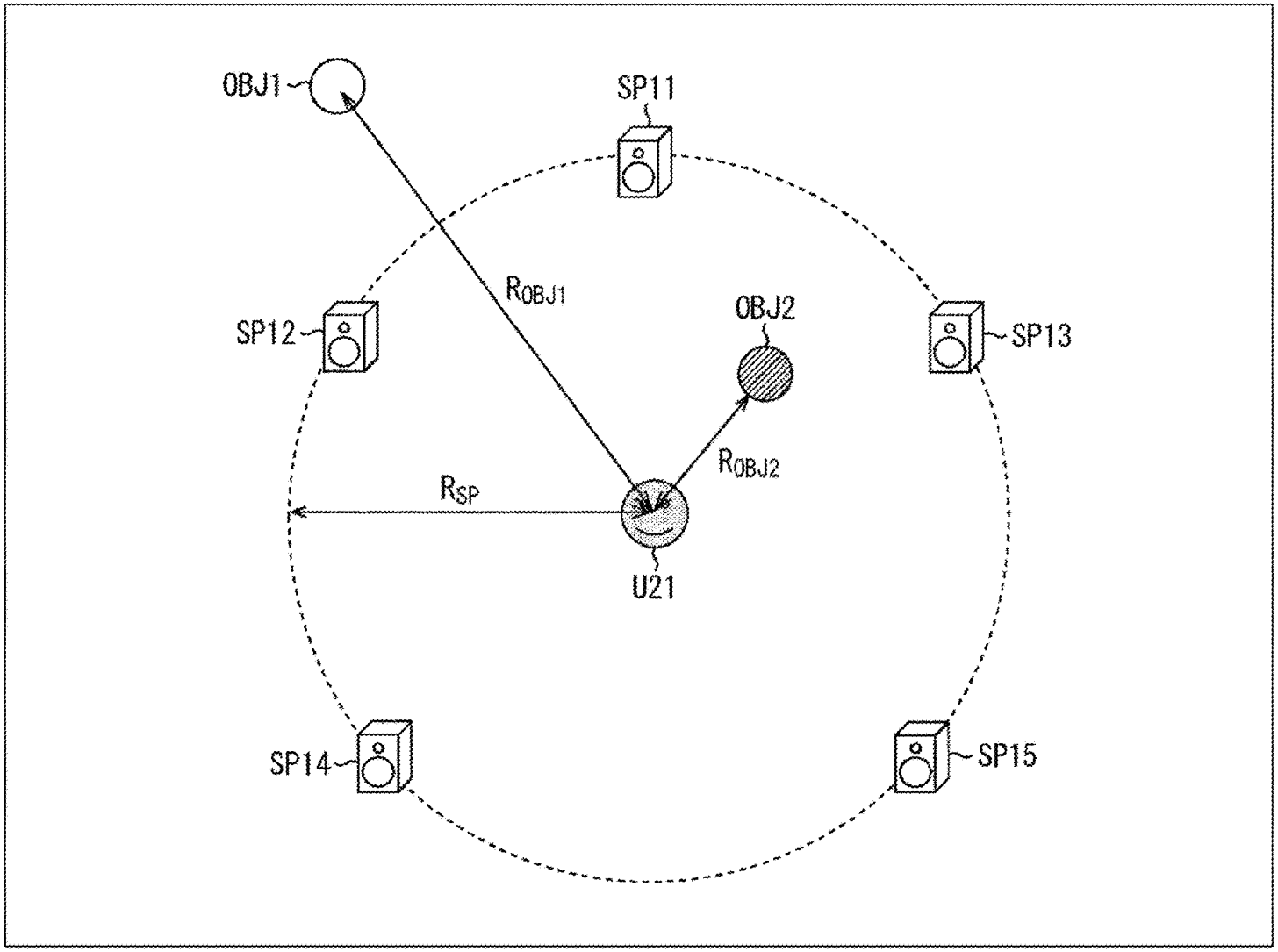
FIG. 6 is a diagram for describing selection of a rendering method.
Figure 7:
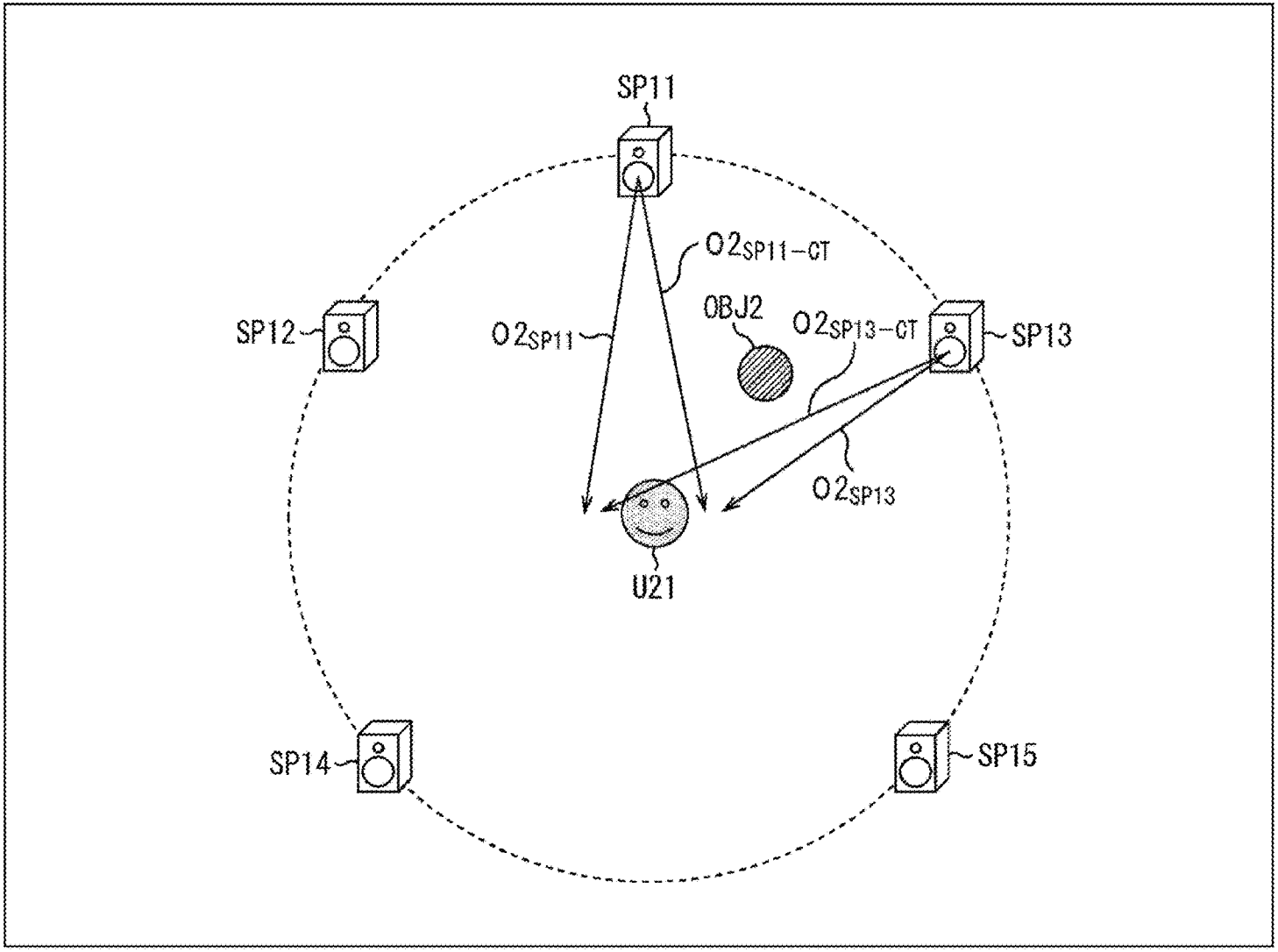
FIG. 7 is a diagram for describing head-related transfer function processing.
Figure 8:
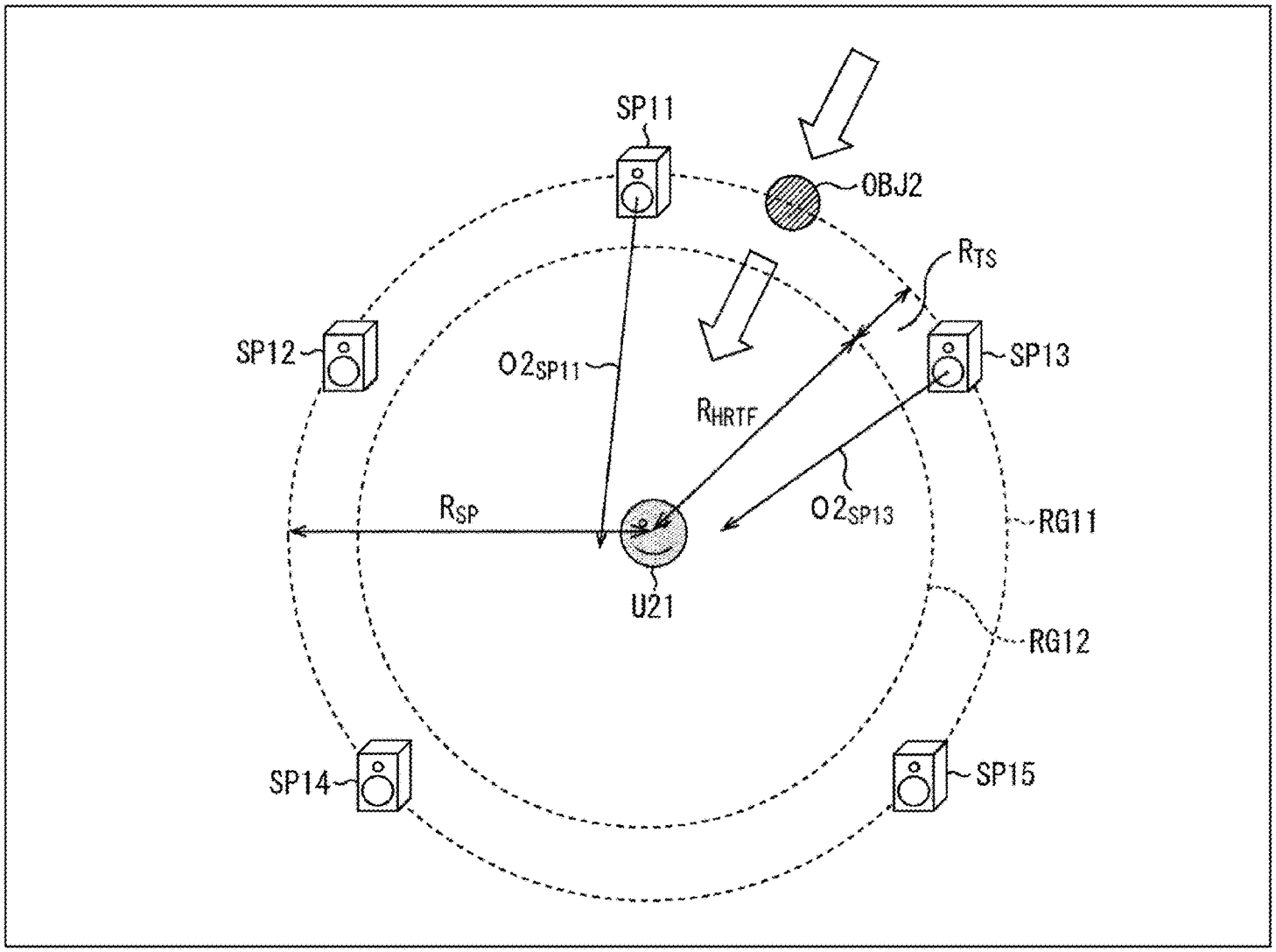
FIG. 8 is a diagram for describing selection of a rendering method.

Note that, in FIGS. 6 to 8, portions corresponding to each other are denoted by the same reference numeral, and description thereof is omitted as appropriate. Furthermore, in the present technology, the listening space is assumed to be a three-dimensional space. However, the present technology is applicable to a case where the listening space is a two-dimensional plane. In FIGS. 6 to 8, description will be given on the assumption that the listening space is a two-dimensional plane for the sake of simplicity.

For example, as illustrated in FIG. 6, it is assumed that a listener U21 who is a user listening to the sound of the content is located at the position of the origin O, and five speakers SP11 to SP15 used for reproduction of the sound of the content are arranged on a circumference of a circle having a radius $R_{SP}$ centered on the origin O. That is, the distance from the origin O to each of the speakers SP11 to SP15 is the radius $R_{SP}$ on a horizontal place including the origin O.

Furthermore, two audio objects OBJ1 and audio objects OBJ2 are present in the listening space. Then, the distance from the origin O, that is, the listener U21 to the audio object OBJ1 is $R_{OBJ1}$, and the distance from the origin O to the audio object OBJ2 is $R_{OBJ2}$.

In particular, here, since the audio object OBJ1 is located outside the circle in which the speakers are arranged, the distance $R_{OBJ1}$ has a larger value than the radius $R_{SP}$.

In contrast, since the audio object OBJ2 is located inside the circle in which the speakers are arranged, the distance $R_{OBJ2}$ has a smaller value than the radius $R_{SP}$.

These distances $R_{OBJ1}$ and $R_{OBJ2}$ are radii position_radius [i] included in the respective pieces of audio object position information of the audio objects OBJ1 and OBJ2.

The rendering method selection unit 51 selects a rendering method to be performed for the audio objects OBJ1 and OBJ2 by comparing the predetermined radius $R_{SP}$ with the distances $R_{OBJ1}$ and $R_{OBJ2}$.

Specifically, for example, in a case where the distance from the origin O to the audio object is equal to or larger than the radius $R_{SP}$, the panning processing is selected as the rendering method.

In contrast, in a case where the distance from the origin O to the audio object is less than the radius $R_{SP}$, the head-related transfer function processing is selected as the rendering method.

Therefore, in this example, the panning processing is selected for the audio object OBJ1 having the distance $R_{OBJ1}$ that is equal to or larger than the radius $R_{SP}$, and the audio object position information and the audio object signal of the audio object OBJ1 are supplied to the panning processing unit 52. Then, the panning processing unit 52 performs, for example, the processing such as VBAP described with reference to FIG. 1 as the panning processing, for the audio object OBJ1.

Meanwhile, the head-related transfer function processing is selected for the audio object OBJ2 having the distance $R_{OBJ2}$ that is less than the radius $R_{SP}$, and the audio object position information and the audio object signal of the audio object OBJ2 are supplied to the head-related transfer function processing unit 53.

Then, the head-related transfer function processing unit 53 performs the head-related transfer function processing using the head-related transfer function as illustrated in FIG. 7, for example, for the audio object OBJ2, and generates the head-related transfer function processing output signal for the audio object OBJ2.

In the example illustrated in FIG. 7, first, the head-related transfer function processing unit 53 reads out the head-related transfer functions for the right and left ears, more specifically, the head-related transfer function filters prepared in advance for the position in the listening space of the audio object OBJ2 on the basis of the audio object position information of the audio object OBJ2.

Here, for example, some points in the area inside the circle (on the origin O side) where the speakers SP11 to SP15 are arranged are set as sampling points. Then, for each of these sampling points, a head-related transfer function indicating a transfer characteristic of a sound from the sampling point to the ear of the listener U21 located at the origin O is prepared in advance for each of the right and left ears and is held in the head-related transfer function processing unit 53.

The head-related transfer function processing unit 53 reads the head-related transfer function of the sampling point closest to the position of the audio object OBJ2 as the head-related transfer function at the position of the audio object OBJ2. Note that the head-related transfer function at the position of the audio object OBJ2 may be generated by interpolation processing such as linear interpolation from the head-related transfer functions at some sampling points near the position of the audio object OBJ2.

In addition, for example, the head-related transfer function at the position of the audio object OBJ2 may be stored in the metadata of the input bit stream. In such a case, the rendering method selection unit 51 supplies the audio object position information supplied from the core decoding processing unit 21 and the head-related transfer function to the head-related transfer function processing unit 53 as metadata.

Hereinafter, the head-related transfer function at the position of the audio object is also particularly referred to as an object position head-related transfer function.

Next, the head-related transfer function processing unit 53 selects a speaker (channel) to which a signal of a sound to be presented to each of the right and left ears of the listener U21 is supplied as the output audio signal (head-related transfer function processing output signal) on the basis of the position in the listening space of the audio object OBJ2. Hereinafter, the speaker serving as the output destination of the output audio signal of the sound to be presented to the left or right ear of the listener U21 will be particularly referred to as a selected speaker.

Here, for example, the head-related transfer function processing unit 53 selects the speaker SP11 located on the left side of the audio object OBJ2 as viewed from the listener U21 and located at the position closest to the audio object OBJ2, as the selected speaker for the left ear. Similarly, the head-related transfer function processing unit 53 selects the speaker SP13 located on the right side of the audio object OBJ2 as viewed from the listener U21 and located at the position closest to the audio object OBJ2, as the selected speaker for the right ear.

When the selected speakers for the right and left ears are selected as described above, the head-related transfer function processing unit 53 obtains the head-related transfer functions, more specifically, the head-related transfer function filters, at the arrangement positions of the selected speakers.

Specifically, for example, the head-related transfer function processing unit 53 appropriately performs the interpolation processing to generate the head-related transfer functions at the positions of the speakers SP11 and SP13 on the basis of the head-related transfer functions at the sampling positions held in advance.

Note that, in addition, the head-related transfer functions at the arrangement positions of the speakers may be held in advance in the head-related transfer function processing unit 53, or the head-related transfer function at the arrangement position of the selected speaker may be stored in the input bit stream as metadata.

Hereinafter, the head-related transfer function at the arrangement position of the selected speaker is also referred to as a speaker position head-related transfer function.

Furthermore, the head-related transfer function processing unit 53 convolves the audio object signal of the audio object OBJ2 and the left-ear object position head-related transfer function, and convolves a signal obtained as a result of the convolution and the left-ear speaker position head-related transfer function to generate a left-ear audio signal.

Similarly, the head-related transfer function processing unit 53 convolves the audio object signal of the audio object OBJ2 and the right-ear object position head-related transfer function, and convolves a signal obtained as a result of the convolution and the right-ear speaker position head-related transfer function to generate a right-ear audio signal.

These left ear audio signal and right ear audio signal are signals for presenting the sound of the audio object OBJ2 to cause the listener U21 to perceive the sound as if it came from the position of the audio object OBJ2. That is, the left ear audio signal and the right ear audio signal are audio signals that implement sound image localization at the position of the audio object OBJ2.

For example, it is assumed that a reproduced sound $O2_{SP11}$ is presented to the left ear of the listener U21 by outputting the sound from the speaker SP11 on the basis of the left ear audio signal, and at the same time, a reproduced sound $O2_{SP13}$ is presented to the right ear of the listener U21 by outputting the sound from the speaker SP13 on the basis of the right ear audio signal. In this case, the listener U21 perceives the sound of the audio object OBJ2 as if the sound was heard from the position of the audio object OBJ2.

In FIG. 7, the reproduced sound $O2_{SP11}$ is represented by an arrow connecting the speaker SP11 and the left ear of the listener U21, and the reproduced sound $O2_{SP13}$ is represented by an arrow connecting the speaker SP13 and the right ear of the listener U21.

However, when the sound is actually output from the speaker SP11 on the basis of the left ear audio signal, the sound reaches not only the left ear but also the right ear of the listener U21.

In FIG. 7, a reproduced sound $O2_{SP11\text{-}CT}$ propagating from the speaker SP11 to the right ear of the listener U21 when the sound is output from the speaker SP11 on the basis of the left ear audio signal is represented by an arrow connecting the speaker SP11 and the right ear of the listener U21.

The reproduced sound $O2_{SP11\text{-}CT}$ is a crosstalk component of the reproduced sound $O2_{SP11}$ that leaks to the right ear of the listener U21. That is, the reproduced sound $O2_{SP11\text{-}CT}$ is a crosstalk component of the reproduced sound $O2_{SP11}$ reaching the untargeted ear (here, the right ear) of the listener U21.

Similarly, when the sound is output from the speaker SP13 on the basis of the right ear audio signal, the sound reaches not only the targeted right ear of the listener U21 but also the untargeted left ear of the listener U21.

In FIG. 7, a reproduced sound $O2_{SP13\text{-}CT}$ propagating from the speaker SP13 to the left ear of the listener U21 when the sound is output from the speaker SP13 on the basis of the right ear audio signal is represented by an arrow connecting the speaker SP13 and the left ear of the listener U21. The reproduced sound $O2_{SP13\text{-}CT}$ is a crosstalk component of the reproduced sound $O2_{SP13}$.

Since the reproduced sound $O2_{SP11\text{-}CT}$ and the reproduced sound $O2_{SP13\text{-}CT}$, which are crosstalk components, are factors that significantly impair the sound image reproducibility, space transfer function correction processing including crosstalk correction is generally performed.

That is, the head-related transfer function processing unit 53 generates a cancel signal for canceling the reproduced sound $O2_{SP11\text{-}CT}$, which is a crosstalk component, on the basis of the left ear audio signal, and generates a final left ear audio signal on the basis of the left ear audio signal and the cancel signal. Then, the final left ear audio signal including a crosstalk cancel component and a space transfer function correction component obtained in this manner is used as the head-related transfer function processing output signal of the channel corresponding to the speaker SP11.

Similarly, the head-related transfer function processing unit 53 generates a cancel signal for canceling the reproduced sound $O2_{SP13\text{-}CT}$, which is a crosstalk component, on the basis of the right ear audio signal, and generates a final right ear audio signal on the basis of the right ear audio signal and the cancel signal. Then, the final right ear audio signal including a crosstalk cancel component and a space transfer function correction component obtained in this manner is used as the head-related transfer function processing output signal of the channel corresponding to the speaker SP13.

The processing of performing rendering on the speaker including the crosstalk correction processing of generating the left ear audio signal and the right ear audio signal as described above is called transaural processing. Such transaural processing is described in detail in, for example, Japanese Patent Application Laid-Open No. 2016-140039 and the like.

Note that, here, an example of selecting one speaker for each of the right and left ears as the selected speaker has been described. However, two or more speakers may be selected for each of the right and left ears as the selected speakers, and the left ear audio signal and the right ear audio signal may be generated for the each two or more selected speakers. For example, all of speakers constituting the speaker system, such as the speakers SP11 to SP15, may be selected as the selected speakers.

Moreover, for example, in a case where the output destination of the output audio signal is a reproduction device such as a headphone of right and left two channels, binaural processing may be performed as the head-related transfer function processing. The binaural processing is rendering processing of rendering an audio object (audio object signal) to an output unit such as a headphone worn on the right and left ears, using a head-related transfer function.

In this case, for example, in a case where the distance from a listening position to the audio object is equal to or larger than a predetermined distance, the panning processing of distributing a gain to the right and left channels is selected as the rendering method. On the other hand, in a case where the distance from the listening position to the audio object is less than the predetermined distance, the binaural processing is selected as the rendering method.

By the way, the description in FIG. 6 has been given such that the panning processing or the head-related transfer function processing is selected as the rendering method for the audio object according to whether or not the distance from the origin O (listener U21) to the audio object is equal to or larger than the radius $R_{SP}$.

However, for example, the audio object may gradually approach the listener U21 over time from a position at a distance of the radius $R_{SP}$ or longer, as illustrated in FIG. 8.

FIG. 8 illustrates a state in which the audio object OBJ2 located at a position at a distance longer than the radius $R_{SP}$ as viewed from the listener U21 at a predetermined time approaches the listener U21 over time.

Here, a region inside the circle of the radius $R_{SP}$ centered on the origin O is defined as a speaker radius region RG11, a region inside the circle of the radius $R_{HRTF}$ centered on the origin O is defined as an HRTF region RG12, and a region other than the HRTF region RG12 in the speaker radius region RG11 is defined as a transition region $R_{TS}$.

That is, the transition region $R_{TS}$ is a region where the distance from the origin O (listener U21) is the distance from the radius $R_{HRTF}$ and the radius $R_{SP}$.

Now, for example, it is assumed that the audio object OBJ2 gradually moves from the position outside the speaker radius region RG11 toward the listener U21 side, and reaches a position within the transition region $R_{TS}$ at certain timing, and then further moves to and has reached a position within the HRTF region RG12.

In such a case, if the rendering method is selected according to whether or not the distance to the audio object OBJ2 is equal to or larger than the radius $R_{SP}$, the rendering method is suddenly switched at the point of time when the audio object OBJ2 has reached the inside of the transition region $R_{TS}$. Then, discontinuity may occur in the sound of the audio object OBJ2, which may cause a feeling of strangeness.

Therefore, when the audio object is located in the transition region $R_{TS}$, both the panning processing and the head-related transfer function processing may be selected as the rendering method so that the feeling of strangeness does not occur at the timing of switching the rendering method.

In this case, when the audio object is on a boundary of the speaker radius region RG11 or outside the speaker radius region RG11, the panning processing is selected as the rendering method.

Furthermore, when the audio object is within the transition region $R_{TS}$, that is, when the distance from the listening position to the audio object is equal to or larger than the radius $R_{HRTF}$ and is smaller than the radius $R_{SP}$, both the panning processing and the head-related transfer function processing are selected as the rendering method.

Then, when the audio object is within the HRTF region RG12, the head-related transfer function processing is selected as the rendering method.

In particular, when the audio object is within the transition region $R_{TS}$, a mixing ratio (blend ratio) of the head-related transfer function processing output signal and the panning processing output signal in the correction processing is changed according to the position of the audio object, whereby occurrence of the discontinuity of the sound of the audio object in a time direction can be prevented.

At this time, the correction processing is performed such that the final output audio signal becomes closer to the panning processing output signal as the audio object is located closer to the boundary position of the speaker radius region RG11 in the transition region $R_{TS}$.

Conversely, the correction processing is performed such that the final output audio signal becomes closer to the head-related transfer function processing output signal as the audio object is located closer to the boundary position of the HRTF region RG12 in the transition region $R_{TS}$.

By doing so, occurrence of discontinuity of the sound of the audio object in the time direction can be prevented, and reproduction of a natural sound without a feeling of strangeness can be implemented.

Here, as a specific example of the correction processing, a case in which the audio object OBJ2 is located at a position in the transition region $R_{TS}$, the position having a distance $R_0$ from the origin O (note that $R_{HRTF} \leq R_0 < R_{SP}$) will be described.

Note that, here, for simplicity of description, description will be given using a case where only signals of the channel corresponding to the speaker SP11 and of the channel corresponding to the speaker SP13 are generated as the output audio signals, as an example.

For example, the panning processing output signal of the channel corresponding to the speaker SP11, the signal being generated by the panning processing, is $O2_{PAN11}(R_0)$, and the panning processing output signal of the channel corresponding to the speaker SP13, the signal being generated by the panning processing, is $O2_{PAN13}(R_0)$.

Furthermore, the head-related transfer function processing output signal of the channel corresponding to the speaker SP11, the signal being generated by the head-related transfer function processing, is $O2_{HRTF11}(R_0)$, and the head-related transfer function processing output signal of the channel corresponding to the speaker SP13, the signal being generated by the head-related transfer function processing, is $O2_{HRTF13}(R_0)$.

In this case, the output audio signal $O2_{SP11}(R_0)$ of the channel corresponding to the speaker SP11 and the output audio signal $O2_{SP13}(R_0)$ of the channel corresponding to the speaker SP13 can be obtained by calculating the following expression (3). That is, the mixing processing unit 54 performs calculation of the following expression (3) as the correction processing.

[Math. 3]

$$O2_{SP11}(R_0) = \frac{R_0 - R_{HRTF}}{R_{SP} - R_{HRTF}} \cdot O2_{PAN11}(R_0) + \frac{R_{SP} - R_0}{R_{SP} - R_{HRTF}} \cdot O2_{HRTF11}(R_0) \tag{3}$$

$$O2_{SP13}(R_0) = \frac{R_0 - R_{HRTF}}{R_{SP} - R_{HRTF}} \cdot O2_{PAN13}(R_0) + \frac{R_{SP} - R_0}{R_{SP} - R_{HRTF}} \cdot O2_{HRTF13}(R_0)$$

In the case where the audio object is within the transition region $R_{TS}$, as described above, the correction processing of adding (combining) the panning processing output signal and the head-related transfer function processing output signal at a proportional ratio according to the distance $R_0$ to the audio object to obtain the output audio signal is performed. In other words, the output of the panning processing and the output of the head-related transfer function processing are proportionally divided according to the distance $R_0$.

By doing so, in a case where the audio object moves across the boundary position of the speaker radius region RG11, for example, even in a case where the audio object moves from the outside to the inside of the speaker radius region RG11, a smooth sound without discontinuity can be reproduced.

Note that, in the above description, the case in which the listening position where the listener is present is set as the origin O, and the listening position is always located at the same position has been described as an example. However, the listener may move over time. In such a case, relative positions of the audio object and the speakers as viewed from the origin O are simply recalculated with respect to the position of the listener at each time as the origin O.

<Description of Audio Output Processing>

Figure 9:
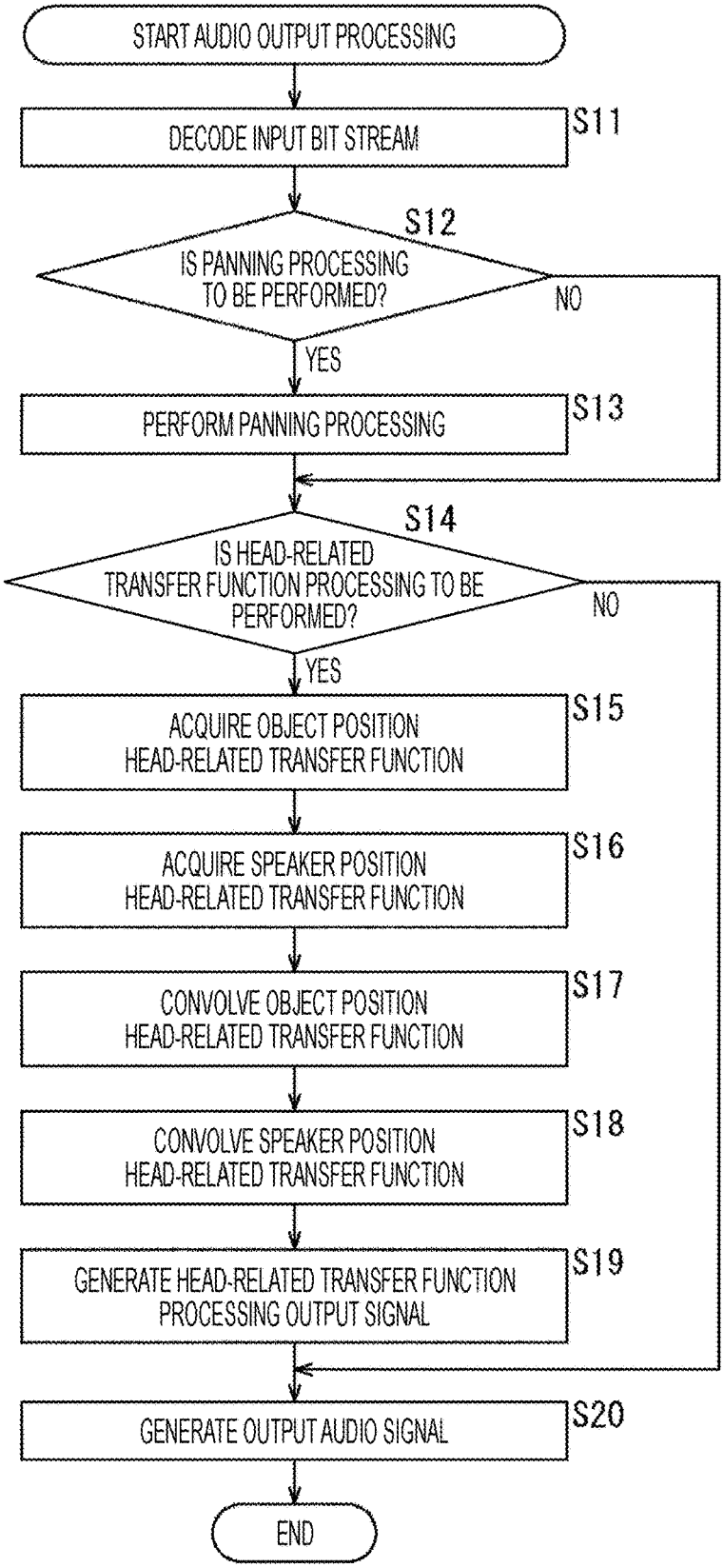
FIG. 9 is a flowchart for describing audio output processing.

Next, a specific operation of the signal processing device 11 will be described. In other words, hereinafter, audio output processing by the signal processing device 11 will be described with reference to the flowchart in FIG. 9. Note that, here, for simplicity, description will be given assuming that only one audio object data is stored in the input bit stream.

In step S11, the core decoding processing unit 21 decodes the received input bit stream, and supplies the audio object position information and the audio object signal obtained as a result of the decoding to the rendering method selection unit 51.

In step S12, the rendering method selection unit 51 determines whether or not to perform the panning processing as the rendering for the audio object on the basis of the audio object position information supplied from the core decoding processing unit 21.

For example, in step S12, in a case where the distance from the listener to the audio object indicated by the audio object position information is equal to or larger than the radius $R_{HRTF}$ described with reference to FIG. 8, the panning processing is determined to be performed. That is, at least the panning processing is selected as the rendering method.

Note that, as another operation, there is an instruction input for giving an instruction on whether or not to perform the panning processing by a user who operates the signal processing device 11 or the like. The panning processing may be determined to be performed in step S12 in a case where execution of the panning processing is specified (instruction thereon is given) by the instruction input. In this case, the rendering method to be executed is selected by the instruction input by the user or the like.

In a case where the panning processing is determined not to be performed in step S12, processing in step S13 is not performed and thereafter the processing proceeds to step S14.

On the other hand, in a case where the panning processing is determined to be performed in step S12, the rendering method selection unit 51 supplies the audio object position information and the audio object signal supplied from the core decoding processing unit 21 to the panning processing unit 52, and thereafter the processing proceeds to step S13.

In step S13, the panning processing unit 52 performs the panning processing on the basis of the audio object position information and the audio object signal supplied from the rendering method selection unit 51 to generate the panning processing output signal.

For example, in step S13, the above-described VBAP or the like is performed as the panning processing. The panning processing unit 52 supplies the panning processing output signal obtained by the panning processing to the mixing processing unit 54.

In a case where the processing in step S13 has been performed or the panning processing is determined not to be performed in step S12, processing in step S14 is performed.

In step S14, the rendering method selection unit 51 determines whether or not to perform the head-related transfer function processing as the rendering for the audio object on the basis of the audio object position information supplied from the core decoding processing unit 21.

For example, in step S14, in a case where the distance from the listener to the audio object indicated by the audio object position information is less than the radius $R_{SP}$ described with reference to FIG. 8, the head-related transfer function processing is determined to be performed. That is, at least the head-related transfer function processing is selected as the rendering method.

Note that, as another operation, there is an instruction input for giving an instruction on whether or not to perform the head-related transfer function processing by the user who operates the signal processing device 11 or the like. The head-related transfer function processing may be determined to be performed in step S14 in a case where execution of the head-related transfer function processing is specified (instruction thereon is given) by the instruction input.

In a case where the head-related transfer function processing is determined not to be performed in step S14, processing in steps S15 to S19 is not performed and thereafter the processing proceeds to step S20.

On the other hand, in a case where the head-related transfer function processing is determined to be performed in step S14, the rendering method selection unit 51 supplies the audio object position information and the audio object signal supplied from the core decoding processing unit 21 to the head-related transfer function processing unit 53, and thereafter the processing proceeds to step S15.

In step S15, the head-related transfer function processing unit 53 acquires the object position head-related transfer function of the position of the audio object on the basis of the audio object position information supplied from the rendering method selection unit 51.

For example, the object position head-related transfer function may an object position head-related transfer function stored in advance to be read, may be obtained by interpolation processing from among a plurality of the head-related transfer functions stored in advance, or may be read from the input bit stream.

In step S16, the head-related transfer function processing unit 53 selects a selected speaker on the basis of the audio object position information supplied from the rendering method selection unit 51, and acquires the speaker position head-related transfer function of the position of the selected speaker.

For example, the speaker position head-related transfer function may a speaker position head-related transfer function stored in advance to be read, may be obtained by interpolation processing from among a plurality of the head-related transfer functions stored in advance, or may be read from the input bit stream.

In step S17, the head-related transfer function processing unit 53 convolves the audio object signal supplied from the rendering method selection unit 51 and the object position head-related transfer function obtained in step S15, for each of the right and left ears.

In step S18, the head-related transfer function processing unit 53 convolves the audio signal obtained in step S17 and the speaker position head-related transfer function, for each of the right and left ears. Thereby, the left ear audio signal and the right ear audio signal are obtained.

In step S19, the head-related transfer function processing unit 53 generates the head-related transfer function processing output signal on the basis of the left ear audio signal and the right ear audio signal, and supplies the head-related transfer function processing output signal to the mixing processing unit 54. For example, in step S19, the cancel signal is generated as appropriate, as described with reference to FIG. 7, and the final head-related transfer function processing output signal is generated.

The transaural processing described with reference to FIG. 8 is performed as the head-related transfer function processing, and the head-related transfer function processing output signal is generated, by the processing in steps S15 to S19 above. Note that, for example, in the case where the output destination of the output audio signal is not a speaker but a reproducing device such as a headphone, the binaural processing or the like is performed as the head-related transfer function processing, and the head-related transfer function processing output signal is generated.

In a case where the processing in step S19 has been performed or the head-related transfer function processing is determined not to be performed in step S14, thereafter processing in step S20 is performed.

In step S20, the mixing processing unit 54 combines the panning processing output signal supplied from the panning processing unit 52 and the head-related transfer function processing output signal supplied from the head-related transfer function processing unit 53 to generate the output audio signal.

For example, in step S20, the calculation of the above expression (3) is performed as the correction processing, and the output audio signal is generated.

Note that, for example, the correction processing is not performed in a case where the processing in step S13 is performed and the processing in steps S15 to S19 is not performed, or in a case where the processing in steps S15 to S19 is performed and the processing in step S13 is not performed.

That is, for example, in the case where only the panning processing is performed as the rendering processing, the panning processing output signal obtained as a result of the panning processing is used as it is as the output audio signal. Meanwhile, in the case where only the head-related transfer function processing is performed as the rendering processing, the head-related transfer function processing output signal obtained as a result of the head-related transfer function processing is used as it is as the output audio signal.

Note that, here, the example in which only the data of one audio object is included in the input bit stream has been described. However, in a case where data of a plurality of audio objects is included, the mixing processing unit 54 performs the mixing processing. That is, the output audio signals obtained for the audio objects are added (combined) for each channel to obtain one final output audio signal.

When the output audio signal is obtained in this way, the mixing processing unit 54 outputs the obtained output audio signal to the subsequent stage, and the audio output processing is terminated.

As described above, the signal processing device 11 selects one or more rendering methods from among the plurality of rendering methods on the basis of the audio object position information, that is, on the basis of the distance from the listening position to the audio object. Then, the signal processing device 11 performs rendering by the selected rendering method to generate the output audio signal.

By doing so, the reproducibility of the sound image can be improved with a small amount of calculation.

That is, the panning processing is selected as the rendering method when the audio object is located at a position far from the listening position, for example. In this case, since the audio object is located at a position sufficiently far from the listening position, it is not necessary to consider the difference in arrival time of the sound to the left and right ears of the listener, and the sound image can be localized with sufficient reproducibility even with a small amount of calculation.

Meanwhile, the head-related transfer function processing is selected as the rendering method when the audio object is located at a position near the listening position, for example. In this case, the sound image can be localized with sufficient reproducibility although the amount of calculation somewhat increases.

In this way, by appropriately selecting the panning processing and the head-related transfer function processing according to the distance from the listening position to the audio object, sound image localization with sufficient reproducibility can be implemented while suppressing the amount of calculation on the whole. In other words, the reproducibility of the sound image can be improved with a small amount of calculation.

Note that, in the above description, the example of selecting the panning processing and the head-related transfer function processing as the rendering methods when the audio object is located within the transition region $R_{TS}$ has been described.

However, the panning processing may be selected as the rendering method in the case where the distance to the audio object is equal or larger than the radius $R_{SP}$, and the head-related transfer function processing may be selected as the rendering method in the case where the distance to the audio object is less than the radius $R_{SP}$.

In this case, when the head-related transfer function processing is selected as the rendering method, for example, the head-related transfer function processing is performed using the head-related transfer function according to the distance from the listening position to the audio object, so that occurrence of discontinuity can be prevented.

Specifically, in the head-related transfer function processing unit 53, the head-related transfer functions for the right and left ears are simply made substantially the same as the distance to the audio object is longer, that is, the position of the audio object is closer to the boundary position of the speaker radius region RG11.

In other words, the head-related transfer function processing unit 53 selects the head-related transfer functions for the right and left ears to be used for the head-related transfer function processing such that the similarity between the left-ear head-related transfer function and the right-ear head-related transfer function becomes higher as the distance to the audio object is closer to the radius $R_{SP}$.

For example, the similarity between the head-related transfer functions becoming higher can be a difference between the left ear head-related transfer function and the right ear head-related transfer function becoming smaller, or the like. In this case, for example, when the distance to the audio object is approximately the radius $R_{SP}$, a common head-related transfer function is used for the left and right ears.

Conversely, the head-related transfer function processing unit 53 uses, as the head-related transfer functions for the right and left ears, head-related transfer functions closer to the head-related transfer function obtained by actual measurement for the position of the audio object, as the distance to the audio object is shorter, that is, the audio object is closer to the listening position.

By doing so, occurrence of discontinuity can be prevented, and reproduction of a natural sound without a feeling of strangeness can be implemented. This is because in a case where the head-related transfer function processing output signal is generated using the same head-related transfer function as the head-related transfer functions for the left and right ears, the head-related transfer function processing output signal becomes the same as the panning processing output signal.

Therefore, by using the head-related transfer functions for the right and left ears according to the distance from the listening position to the audio object, an effect similar to the effect of the above-described correction processing of the expression (3) can be obtained.

Moreover, in selecting the rendering method, the availability of resources of the signal processing device 11, the importance of the audio object, and the like may be considered.

For example, in a case where there are sufficient resources of the signal processing device 11, the rendering method selection unit 51 selects the head-related transfer function processing as the rendering method because a large amount of resources can be allocated to the rendering. Conversely, in a case where there are less sufficient resources of the signal processing device 11, the rendering method selection unit 51 selects the panning processing as the rendering method.

Furthermore, in a case where the importance of the audio object to be processed is equal to or larger than predetermined importance, the rendering method selection unit 51 selects the head-related transfer function processing as the rendering method, for example. In contrast, in a case where the importance of the audio object to be processed is less than the predetermined importance, the rendering method selection unit 51 selects the panning processing as the rendering method.

As a result, the sound image of the audio object with high importance is localized with higher reproducibility, and the sound image of the audio object with low importance is localized with some reproducibility so that the amount of processing can be reduced. As a result, the reproducibility of the sound image can be improved with a small amount of calculation on the whole.

Note that, in the case of selecting the rendering method on the basis of the importance of the audio object, the importance of each audio object may be included in the input bit stream as metadata of the audio object. Furthermore, the importance of the audio object may be specified by an external operation input or the like.

Second Embodiment

<Head-Related Transfer Function Processing>

Furthermore, in the above description, the example of performing the transaural processing as the head-related transfer function processing has been described. That is, the example of performing the rendering on the speaker in the head-related transfer function processing has been described.

However, in addition, rendering for headphone reproduction may be performed using a concept of a virtual speaker, as the head-related transfer function processing, for example.

For example, in a case of rendering a large number of audio objects on a headphone or the like, the calculation cost for performing head-related transfer function processing becomes large, as in the case of performing rendering on a speaker.

Even in headphone rendering in the MPEG-H Part 3:3D audio standard, all the audio objects are once panned (rendered) on a virtual speaker by VBAP and are then rendered on the headphone, using a head-related transfer function from the virtual speaker.

As described above, the present technology can be applied to the case where an output destination of an output audio signal is a reproduction device such as a headphone that reproduces sounds from right and left two channels, and the audio objects are once rendered on a virtual speaker and are then further rendered on the reproduction device using the head-related transfer function.

In such a case, the rendering method selection unit 51 regards speakers SP11 to SP15 illustrated in FIG. 8 as virtual speakers, for example, and simply selects one or more rendering methods from among a plurality of rendering methods as the rendering method at the time of rendering.

For example, in a case where a distance from a listening position to an audio object is equal to or larger than a radius $R_{SP}$, that is, in a case where the audio object is located at a position distant from the position of the virtual speaker as viewed from the listening position, panning processing is simply selected as the rendering method.

In this case, the rendering on the virtual speakers is performed by the panning processing. Then, the rendering on the reproduction device such as a headphone is further performed by the head-related transfer function processing on the basis of the audio signal obtained by the panning processing and a head-related transfer function for each of right and left ears from the virtual speaker to the listening position, and an output audio signal is generated.

In contrast, in a case where the distance to an audio object is less than the radius $R_{SP}$, the head-related transfer function processing is simply selected as the rendering method. In this case, rendering is directly performed on the reproduction device such as a headphone by binaural processing as the head-related transfer function processing, and the output audio signal is generated.

By doing so, sound image localization with high reproducibility can be implemented while suppressing the amount of processing of the rendering on the whole. That is, the reproducibility of the sound image can be improved with a small amount of calculation.

Third Embodiment

<Selection of Rendering Method>

Furthermore, in selecting a rendering method, that is, in switching a rendering method, part or all of parameters required for selecting a rendering method at each time such as each frame may be stored in an input bit stream and transmitted.

In such a case, a coding format based on the present technology, that is, metadata of an audio object, is as illustrated in FIG. 10, for example.

In the example illustrated in FIG. 10, "radius_hrtf" and "radius_panning" are further stored in the metadata, in addition to the above-described example illustrated in FIG. 4.

Here, radius_hrtf is information (parameter) indicating a distance from a listening position (origin O) used for determining whether or not to select head-related transfer function processing as the rendering method. In contrast, radius_panning is information (parameter) indicating a distance from the listening position (origin O) used for determining whether or not to select panning processing as the rendering method.

Therefore, in the example illustrated in FIG. 10, audio object position information of each audio object, the distance radius_hrtf, and the distance radius_panning are stored in the metadata. These pieces of information are read by a core decoding processing unit 21 as metadata and supplied to the rendering method selection unit 51.

In this case, a rendering method selection unit 51 selects head-related transfer function processing as a rendering method when a distance from a listener to an audio object is equal to or less than the distance radius_hrtf regardless of a radius $R_{SP}$ indicating a distance to each speaker. Furthermore, the rendering method selection unit 51 does not select the head-related transfer function processing as the rendering method when the distance from the listener to the audio object is longer than the distance radius_hrtf.

Similarly, the rendering method selection unit 51 selects panning processing as a rendering method when the distance from the listener to the audio object is equal or larger than the distance radius_panning. Furthermore, the rendering method selection unit 51 does not select the panning processing as the rendering method when the distance from the listener to the audio object is shorter than the distance radius_panning.

Note that the distance radius_hrtf and the distance radius_panning may be the same distance or different distances from each other. In particular, in a case where the distance radius_hrtf is larger than the distance radius_panning, when the distance from the listener to the audio object is equal to or larger than the distance radius_panning and equal to or less than the distance radius_hrtf, both the panning processing and the head-related transfer function processing are selected as the rendering methods.

In this case, a mixing processing unit 54 performs calculation of the above-described expression (3) on the basis of a panning processing output signal and a head-related transfer function processing output signal to generate an output audio signal. That is, the output audio signal is generated by proportionally dividing the panning processing output signal and the head-related transfer function processing output signal according to the distance from the listener to the audio object, by correction processing.

First Modification of Third Embodiment

<Selection of Rendering Method>

Moreover, a rendering method at each time such as each frame is selected for each audio object on an output side of an input bit stream, that is, on a content creator side, and selection instruction information indicating a selection result may be stored in the input bit stream as metadata.

The selection instruction information is information indicating an instruction as to what rendering method to select for an audio object, and the rendering method selection unit 51 selects the rendering method on the basis of the selection instruction information supplied from the core decoding processing unit 21. In other words, the rendering method selection unit 51 selects the rendering method specified by the selection instruction information for an audio object signal.

In a case where the selection instruction information is stored in an input bit stream, a coding format based on the present technology, that is, metadata of the audio object, is as illustrated in FIG. 11, for example.

In the example illustrated in FIG. 11, "flg_rendering_type" is further stored in the metadata, in addition to the above-described example illustrated in FIG. 4.

flg_rendering_type is the selection instruction information indicating which rendering method is to be used. In particular, here, the selection instruction information flg_rendering_type is flag information (parameter) indicating whether to select panning processing or head-related transfer function processing as a rendering method.

Specifically, for example, a value "0" of the selection instruction information flg_rendering_type indicates that the panning processing is selected as the rendering method. Meanwhile, a value "1" of the selection instruction information flg_rendering_type indicates that the head-related transfer function processing is selected as the rendering method.

For example, the metadata stores such selection instruction information flg_rendering_type for each audio object for each frame (each time).

Therefore, in the example illustrated in FIG. 11, audio object position information and the selection instruction information flg_rendering_type are stored in the metadata, for each audio object. These pieces of information are read by a core decoding processing unit 21 as metadata and supplied to the rendering method selection unit 51.

In this case, the rendering method selection unit 51 selects the rendering method according to the value of the selection instruction information flg_rendering_type regardless of a distance from a listener to the audio object. That is, the rendering method selection unit 51 selects the panning processing as the rendering method when the value of the selection instruction information flg_rendering_type is "0", and selects the head-related transfer function processing as the rendering method when the value of the selection instruction information flg_rendering_type is "1".

Note that, here, the example in which the value of the selection instruction information flg_rendering_type is either "0" or "1" has been described. However, the selection instruction information flg_rendering_type may be any of three or more types of a plurality of values. For example, in the case where the value of the selection instruction information flg_rendering_type is "2", the panning processing and the head-related transfer function processing can be selected as the rendering methods.

As described above, according to the present technology, sound image expression with high reproducibility can be implemented while suppressing the amount of calculation even in a case where a large number of audio objects are present, as described in the first embodiment to the first modification of the third embodiment, for example.

In particular, the present technology is applicable not only to speaker reproduction using a real speaker but also to headphone reproduction by rendering using a virtual speaker.

Furthermore, according to the present technology, by storing parameters necessary for selection of a rendering method in the coding standard, that is, in the input bit stream, as metadata, the content creator side can control the selection of a rendering method.

<Configuration Example of Computer>

By the way, the above-described series of processing can be executed by hardware or software. In the case of executing the series of processing by software, a program that configures the software is installed in a computer. Here, examples of the computer include a computer incorporated in dedicated hardware, and a general-purpose personal computer or the like capable of executing various functions by installing various programs, for example.

Figure 12:
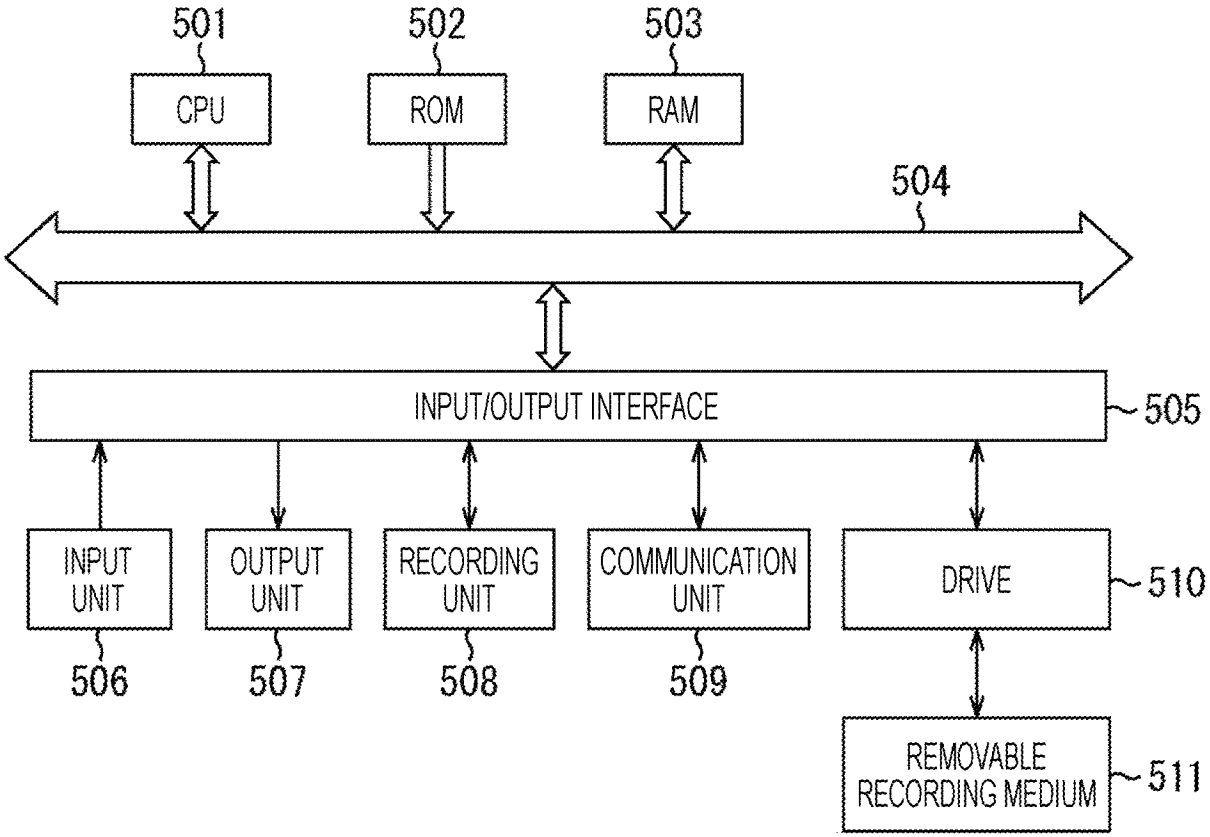
FIG. 12 is a diagram illustrating a configuration example of a computer.

FIG. 12 is a block diagram illustrating a configuration example of hardware of a computer that executes the above-described series of processing by a program.

In a computer, a central processing unit (CPU) 501, a read only memory (ROM) 502, and a random access memory (RAM) 503 are mutually connected by a bus 504.

Moreover, an input/output interface 505 is connected to the bus 504. An input unit 506, an output unit 507, a recording unit 508, a communication unit 509, and a drive 510 are connected to the input/output interface 505.

The input unit 506 includes a keyboard, a mouse, a microphone, an imaging element, and the like. The output unit 507 includes a display, a speaker, and the like. The recording unit 508 includes a hard disk, a nonvolatile memory, and the like. The communication unit 509 includes a network interface and the like. The drive 510 drives a removable recording medium 511 such as a magnetic disk, an optical disk, a magneto-optical disk, or a semiconductor memory.

In the computer configured as described above, the CPU 501 loads a program recorded in the recording unit 508 into the RAM 503, for example, and executes the program via the input/output interface 505 and the bus 504, thereby performing the above-described series of processing.

The program to be executed by the computer (CPU 501) can be recorded on the removable recording medium 511 as a package medium or the like, for example, and provided. Furthermore, the program can be provided via a wired or wireless transmission medium such as a local area network, the Internet, or digital satellite broadcast.

In the computer, the program can be installed to the recording unit 508 via the input/output interface 505 by attaching the removable recording medium 511 to the drive 510. Furthermore, the program can be received by the communication unit 509 via a wired or wireless transmission medium and installed in the recording unit 508. Other than the above method, the program can be installed in the ROM 502 or the recording unit 508 in advance.

Note that the program executed by the computer may be a program processed in chronological order according to the order described in the present specification or may be a program executed in parallel or at necessary timing such as when a call is made.

Furthermore, embodiments of the present technology are not limited to the above-described embodiments, and various modifications can be made without departing from the gist of the present technology.

For example, in the present technology, a configuration of cloud computing in which one function is shared and processed in cooperation by a plurality of devices via a network can be adopted.

Furthermore, the steps described in the above-described flowcharts can be executed by one device or can be shared and executed by a plurality of devices.

Moreover, in the case where a plurality of processes is included in one step, the plurality of processes included in the one step can be executed by one device or can be shared and executed by a plurality of devices.

Moreover, the present technology may be configured as follows.

(1)

A signal processing device including:

a rendering method selection unit configured to select one or more methods of rendering processing of localizing a sound image of an audio signal in a listening space from among a plurality of methods; and a rendering processing unit configured to perform the rendering processing for the audio signal by the method selected by the rendering method selection unit.

(2)

The signal processing device according to (1), in which the audio signal is an audio signal of an audio object.

(3)

The signal processing device according to (1) or (2), in which the plurality of methods includes panning processing.

(4)

The signal processing device according to any one of (1) to (3), in which the plurality of methods includes the rendering processing using a head-related transfer function.

(5)

The signal processing device according to (4), in which the rendering processing using the head-related transfer function is transaural processing or binaural processing.

(6)

The signal processing device according to (2), in which the rendering method selection unit selects the method of the rendering processing on the basis of a position of the audio object in the listening space.

(7)

The signal processing device according to (6), in which, in a case where a distance from a listening position to the audio object is equal to or larger than a predetermined first distance, the rendering method selection unit selects panning processing as the method of the rendering processing.

(8)

The signal processing device according to (7), in which, in a case where the distance is less than the first distance, the rendering method selection unit selects the rendering processing using a head-related transfer function as the method of the rendering processing.

(9)

The signal processing device according to (8), in which, in a case where the distance is less than the first distance, the rendering processing unit performs the rendering processing using the head-related transfer function according to the distance from the listening position to the audio object.

(10)

The signal processing device according to (9), in which the rendering processing unit selects the head-related transfer function to be used for the rendering processing such that a difference between the head-related transfer function for a left ear and the head-related transfer function for a right ear becomes smaller as the distance becomes closer to the first distance.

(11)

The signal processing device according to (7), in which, in a case where the distance is less than a second distance different from the first distance, the rendering method selection unit selects the rendering processing using a head-related transfer function as the method of the rendering processing.

(12)

The signal processing device according to (11), in which, in a case where the distance is equal to or larger than the first distance and is less than the second distance, the rendering method selection unit selects the panning processing and the rendering processing using a head-related transfer function as the method of the rendering processing.

(13)

The signal processing device according to (12), further including:

an output audio signal generation unit configured to combine a signal obtained by the panning processing and a signal obtained by the rendering processing using the head-related transfer function to generate an output audio signal.

(14)

The signal processing device according to any one of (1) to (5), in which the rendering method selection unit selects a method specified for the audio signal as the method of the rendering processing.

(15)

A signal processing method for causing a signal processing device to perform:

selecting one or more methods of rendering processing of localizing a sound image of an audio signal in a listening space from among a plurality of methods; and performing the rendering processing for the audio signal by the selected method.

(16)

A program for causing a computer to execute processing including the steps of:

selecting one or more methods of rendering processing of localizing a sound image of an audio signal in a listening space from among a plurality of methods; and performing the rendering processing for the audio signal by the selected method.

REFERENCE SIGNS LIST

11 Signal processing device
21 Core decoding processing unit
22 Rendering processing unit
51 Rendering method selection unit
52 Panning processing unit
53 Head-related transfer function processing unit
54 Mixing processing unit

The invention claimed is:

1. A signal processing device comprising:

processing circuitry configured to:

select at least one method of rendering processing of localizing a sound image of an audio signal in a listening space from among a plurality of methods; and perform the rendering processing for the audio signal by the selected at least one method, wherein the audio signal is an audio signal of an audio object, wherein the processing circuitry is configured to select three-dimensional vector-based amplitude panning (VBAP) for performing rendering processing when a distance from a listening position to the audio object is equal to or greater than a predetermined first distance, wherein the processing circuitry is configured to select a head-related transfer function for performing rendering processing when the distance from the listening position to the audio object is less than a second distance, the second distance being less than the predetermined first distance, and wherein the processing circuitry is configured to select the three-dimensional VBAP and the head-related transfer function for performing rendering processing when the distance from the listening position to the audio object is less than the predetermined first distance and greater than the second distance.

2. The signal processing device according to claim 1, wherein the rendering processing using the head-related transfer function is transaural processing or binaural processing.

3. The signal processing device according to claim 1, wherein the processing circuitry is configured to select the head-related transfer function to be used for the rendering processing such that a difference between the head-related transfer function for a left ear and the head-related transfer function for a right ear becomes smaller as the distance becomes closer to the predetermined first distance.

4. The signal processing device according to claim 1, wherein the processing circuitry is further configured to combine a signal obtained by the three-dimensional VBAP processing and a signal obtained by the rendering processing using the head-related transfer function to generate an output audio signal.

5. The signal processing device according to claim 1, wherein the processing circuitry is configured to select the at least one method specified in metadata of the audio signal as the method of the rendering processing.

6. A non-transitory computer readable medium storing instructions that, when executed by processing circuitry, perform a signal processing method comprising:

selecting at least one method of rendering processing of localizing a sound image of an audio signal in a listening space from among a plurality of methods; and performing the rendering processing for the audio signal by the selected at least one method, wherein the audio signal is an audio signal of an audio object, wherein the three dimensional VBAP is selected three-dimensional vector-based amplitude panning (VBAP) is selected for performing rendering processing when a distance from a listening position to the audio object is equal to or greater than a predetermined first distance, wherein a head-related transfer function is selected for performing rendering processing when the distance from the listening position to the audio object is less than a second distance, the second distance being less than the predetermined first distance, and wherein the three-dimensional VBAP and the head-related transfer function are selected for performing rendering processing when the distance from the listening position to the audio object is less than the predetermined first distance and greater than the second distance.

* * * * *